US008670803B2

(12) United States Patent
Schuh et al.

(10) Patent No.: US 8,670,803 B2
(45) Date of Patent: Mar. 11, 2014

(54) RADIOFREQUENCY COMMUNICATION DEVICE WITH AN OFFSET ANTENNA

(75) Inventors: Jean-Francois Schuh, La Ciotat (FR); Didier Bonnet, Le Beausset (FR)

(73) Assignee: Gemalto SA, Meudon (FR)

( * ) Notice: Subject to any disclaimer, the term of this patent is extended or adjusted under 35 U.S.C. 154(b) by 120 days.

(21) Appl. No.: 13/130,067

(22) PCT Filed: Nov. 24, 2009

(86) PCT No.: PCT/EP2009/065780

§ 371 (c)(1),
(2), (4) Date: May 19, 2011

(87) PCT Pub. No.: WO2010/060912

PCT Pub. Date: Jun. 3, 2010

(65) Prior Publication Data

US 2011/0230147 A1 Sep. 22, 2011

(30) Foreign Application Priority Data

Nov. 27, 2008 (EP) ..... 08305857

(51) Int. Cl.
*H04M 1/00* (2006.01)

(52) U.S. Cl.
USPC ..... 455/562.1; 455/575.5; 455/575.7; 455/97; 455/129; 455/274

(58) Field of Classification Search
USPC ..... 455/562.1, 575.5, 575.7, 97, 129, 274
See application file for complete search history.

(56) References Cited

U.S. PATENT DOCUMENTS

| | | | | |
|---|---|---|---|---|
| 5,949,384 | A | 9/1999 | Ikushima | |
| 7,231,236 | B2 * | 6/2007 | Cho | 455/575.7 |
| 7,597,259 | B2 * | 10/2009 | Nishikawa et al. | 235/441 |
| 7,974,577 | B2 * | 7/2011 | Stephens, Jr. | 455/41.2 |
| 8,254,994 | B2 * | 8/2012 | Yang | 455/557 |
| 2005/0264460 | A1 | 12/2005 | Sunaga | |
| 2006/0234783 | A1 | 10/2006 | Wang et al. | |
| 2007/0008168 | A1 * | 1/2007 | Liao et al. | 340/825.69 |

(Continued)

FOREIGN PATENT DOCUMENTS

| | | | |
|---|---|---|---|
| DE | 202007012715 | U1 | 12/2007 |
| EP | 1600887 | A2 | 11/2005 |

(Continued)

OTHER PUBLICATIONS

International Search Report (PCT/ISA/210) issued on Apr. 6, 2010, by European Patent Office as the International Searching Authority for International Application No. PCT/EP2009/065780.

(Continued)

*Primary Examiner* — Wen Huang
(74) *Attorney, Agent, or Firm* — Buchanan Ingersoll & Rooney PC

(57) ABSTRACT

The invention relates to a radiofrequency communication device that comprises a gripping beating body having a surface; an electronic and/or electric circuit extending in the gripping beating body; at least one antenna provided in the vicinity of the electronic circuit. The device includes a connection circuit for connection to the antenna, that is provided at least partially in the gripping beating body and extends from the electronic circuit up to connection points of the antenna, said antenna connection points being accessible from the outside of the beating body.

8 Claims, 2 Drawing Sheets

(56) References Cited

U.S. PATENT DOCUMENTS

Figure 1:
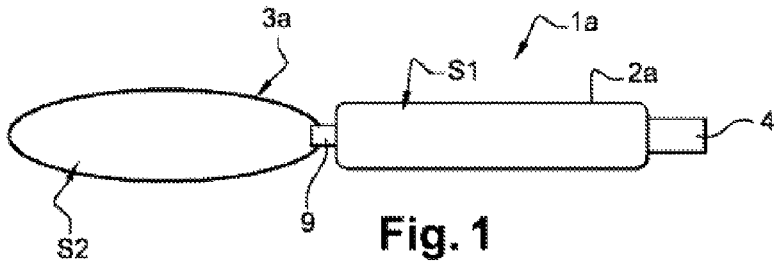

| | | | | |
|---|---|---|---|---|
| 2008/0136737 | A1* | 6/2008 | Fratti et al. | 343/895 |
| 2009/0006677 | A1* | 1/2009 | Rofougaran | 710/63 |
| 2009/0313434 | A1* | 12/2009 | Poo et al. | 711/115 |
| 2010/0124883 | A1* | 5/2010 | Hu et al. | 455/39 |

FOREIGN PATENT DOCUMENTS

| | | | |
|---|---|---|---|
| JP | 2005-348092 | A | 12/2005 |
| JP | 2007-286797 | A | 11/2007 |
| JP | 2008-85439 | A | 4/2008 |
| WO | WO 2007/088898 | A1 | 8/2007 |

OTHER PUBLICATIONS

Written Opinion (PCT/ISA/237) issued on Apr. 6, 2010, by European Patent Office as the International Searching Authority for International Application No. PCT/EP2009/065780.

* cited by examiner

RADIOFREQUENCY COMMUNICATION DEVICE WITH AN OFFSET ANTENNA

The invention generally relates to the field of radiofrequency communication devices.

The invention more particularly concerns a radiofrequency communication device comprising an electronic circuit on a beating body and a radiofrequency antenna at least partially connected to the electronic circuit and defining an electromagnetic coupling surface.

The invention more particularly concerns such devices comprising a USB and RF radiofrequency function, more particularly as per the ISO 14443, ISO 15693 standards, or of the NFC (ISO 18092, ISO 21481, etc.) type.

It finds an application more particularly in the downloading of data though the Internet, more particularly relating to access rights, a subscription to services such as transportation, telephony, through a contact interface and the use of such data in a radiofrequency mode, relating to radiofrequency terminals or reversely.

Such devices are known among, more particularly, USB keys having a RF radiofrequency function aboard, for access control applications. Although it is described in relation with the USB, the invention can apply to any communication device having electric contacts, more particularly linear contacts, such as described in the MMC, SD, Express card, or ISO 7816 standards or any other standard. In the whole document, the word "USB" will also mean any other communication protocol or standard different from the USB one, for simplification purposes.

The capacity of supplying the radiofrequency chip (RFID) through the antenna will depend on the antenna surface, and it is thus desirable to have a USB device with a large surface, which is in contradiction with the conventional use of the USB devices, which are generally small. Such USB devices will thus have a rather reduced efficiency or range, of the order of a few centimeters, with the antenna having a coupling surface at most equal to the surface or overall dimensions of the key, i.e. generally 2 to 3 $cm^2$.

The aim of the invention is to remedy such drawbacks. More particularly, it preferably aims at improving the communication range and quality of the radiofrequency device with reduced overall dimensions intended to be used with some equipment, more particularly through the USB interface of a computer.

According to a first radiofrequency embodiment, the principle of the invention consists in offsetting the RF device antenna, or having it out of one or several electronic circuits or printed circuit boards (PCB), so as to reduce interferences or artefacts with conductive parts of a circuit. The antenna is so positioned with respect to such circuit as to have a coupling surface as little opposite the circuit as possible.

In other words, the device comprises a first radiofrequency communication functional configuration wherein the turn-shaped antenna has at least a portion of the coupling surface (inside the widest turn) having no electronic circuit directly opposite it.

On the other hand, when in electric contact (more particularly USB) use mode, the device preferably comprises a functional configuration wherein the antenna is so arranged as to reduce the device overall dimensions or at least, not to hamper the connection thereof or another connection of USB keys to the other terminal or computer connectors or ports.

According to a more concrete embodiment, the invention consists in having an antenna which is mobile and/or removable and/or flexible with respect to the electronic circuit or a (generally rigid) main body of the device.

For this purpose, the aim of the invention is a radiofrequency communication device that comprises a gripping beating body, a radiofrequency antenna at least partially connected to the electronic circuit. The device is characterised in that it comprises a connection circuit for connection to the antenna, that is provided at least partially in the gripping beating body and extends from the electronic circuit up to connection points of the antenna, said antenna connection points being accessible from the outside of the beating body.

This construction facilitates the construction of a more efficient device, the connection of the antenna, and enables a removable mounting of the antenna, and reduced overall dimensions of the device, if necessary.

According to other characteristics of the device:

- it includes a USB connector including Vbus and GND tracks, with the antenna connection points being respectively connected to such tracks and the antenna having both its connections connected to such tracks;
- the connection circuit comprises two capacities, each one being provided between the electronic circuit and the connection points and a USB circuit protection circuit.
- the antenna is accommodated in a removable cap or element able to connect both antenna ends to the Vbus and GND tracks respectively,
- it comprises a chip card USB driver, with the electronic circuit being a circuit of the USB driver comprising an ISO connector for connecting the chip card, and the chip card comprising an electronic circuit with a dual ISO/RF interface;
- the antenna is removable with respect to the electronic circuit or with respect to the connection points accessible from the outside,
- the antenna is flexible with respect to the electronic circuit;
- the antenna comprises at least a radiofrequency antenna turn provided in the vicinity of the electronic circuit and defining an electromagnetic coupling surface inside the turn.

Thanks to the above provisions, the device has a compact appearance, a configuration of mechanical and electric protection of the connector and an optimum electromagnetic coupling functional position.

Figure 2:
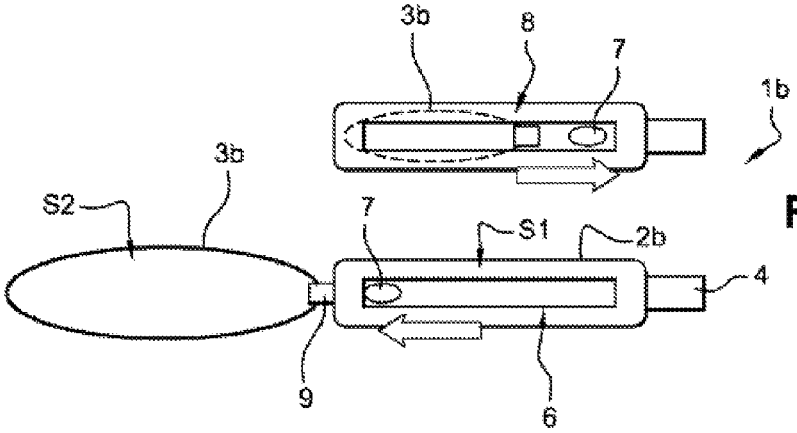
Figure 3:
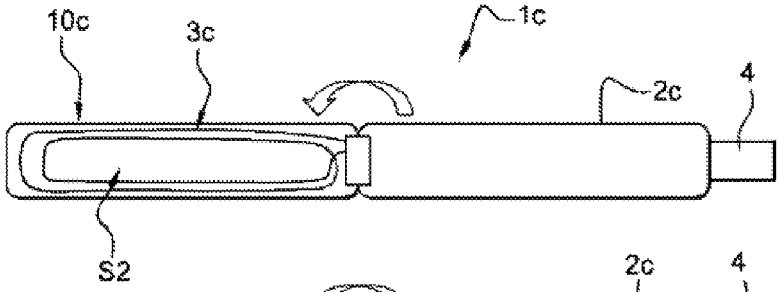
Figure 3A:
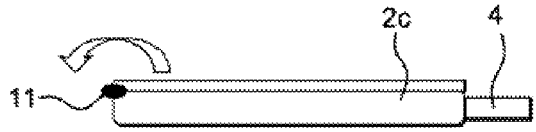
Figure 3B:
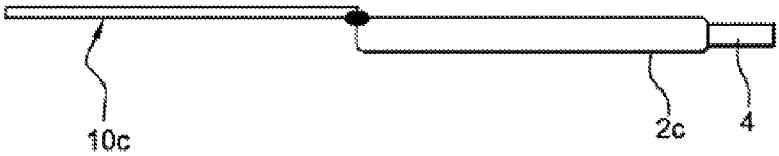
Figure 4:
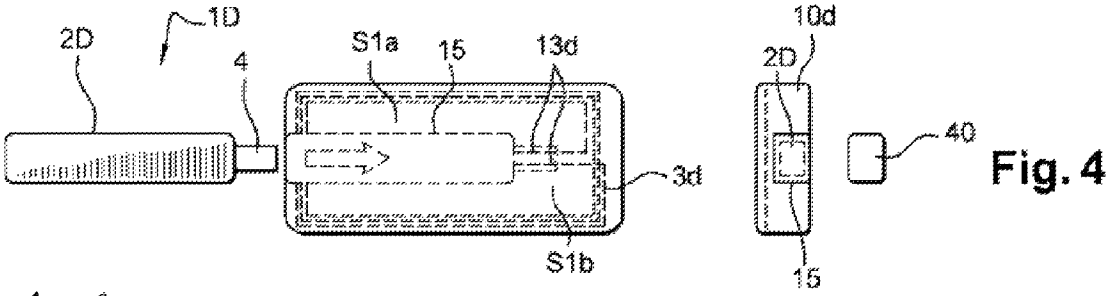
Figure 5:
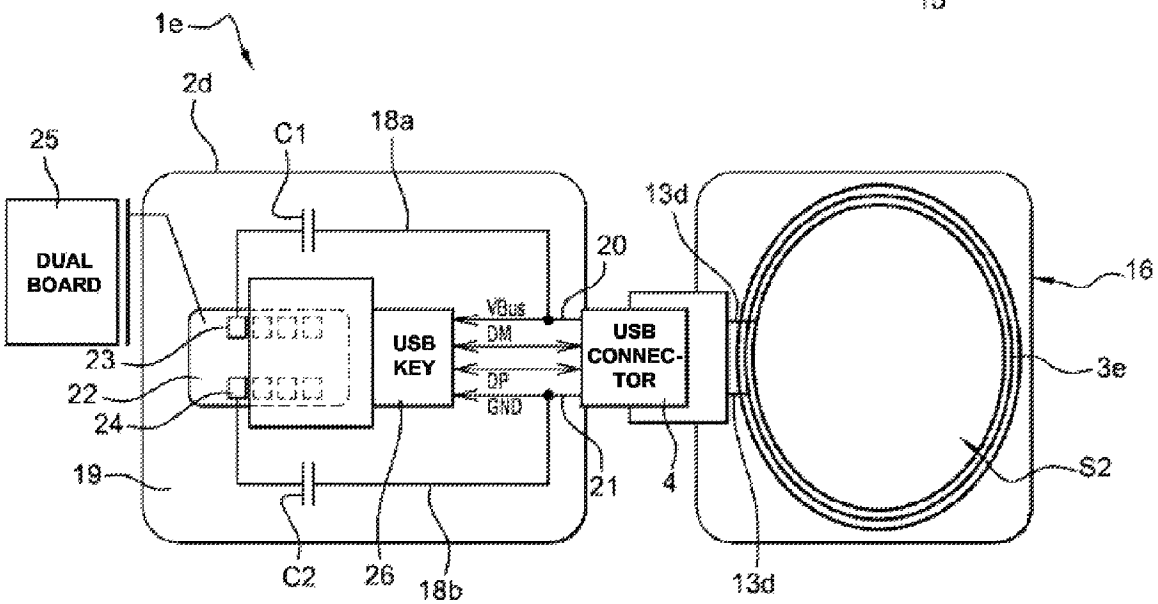

Other characteristics and advantages of the invention will appear upon reading the description, given only as a non-limitative example and referring to the appended drawings, wherein:

FIG. 1 schematically shows the structure of a portable device according to the invention and according to a first embodiment, with antenna flexible means;

FIG. 2 schematically shows the structure of a portable device according to the invention and according to a second embodiment, with antenna retractable means;

FIG. 3 schematically shows the structure of a portable device according to the invention and according to a third embodiment, with antenna mobile, removable or articulated means;

FIGS. 3*a*, 3*b* show the device as seen in profile, with the antenna being in respectively folded and expanded positions of the antenna removable means;

FIG. 4 schematically shows the structure of a portable device according to the invention and according to a fourth embodiment with removable means making it possible to retract or insert the body with respect to the antenna;

FIG. 5 schematically shows the structure of a portable device according to the invention and according to a fifth embodiment, with antenna removable means.

In FIG. 1, a radiofrequency communication device 1*a* according to the invention comprises a gripping beating body 2*a* and an antenna 3. In the example, such device also includes a contact connector 4, here a connector of the USB type. However, the invention may not include any electric contact connector in one embodiment wherein the radiofrequency communication is improved.

The device includes a surface "S1" or overall dimensions, as seen from above, (or for example, along a transversal section parallel to the plane of a connector 4, if any).

The gripping beating body 2*a*, here an external shell, includes an electronic circuit 5*a* (not shown) which extends inside. If need be, the body may directly be any printed circuit board (PCB) or electronic circuit support board.

The circuit may, more particularly, include conductive tracks, connections and/or electronic and/or electric components such as a block of elastic blade connectors or any other ones. As will be seen hereinunder, the device may include components for providing a USB function, a radiofrequency function, provided in a separate card, if need be. Such circuit elements are likely to disturb the radiofrequency communication established with at least one turn 3 of the radiofrequency antenna which is provided in the vicinity of the electronic circuit.

The antenna turn 3 defines an electromagnetic coupling surface "S2" inside the turn.

According to another embodiment, the antenna may be in a form different from turns, such as a UHF antenna, for example.

According to a characteristic of the invention, the antenna 3 has at least one portion of a coupling surface S2 which is free of any electronic circuit and/or conductive tracks directly provided opposite or substantially opposite same.

In the example, the antenna is provided outside the main rigid body 2*a*; on the other hand, the antenna is configured as a loop similar to a key ring extending at the back of the device. The loop includes the supportless antenna turns and forms a circular armature in itself. The loop is preferably enclosed in a material for protecting and/or mechanically reinforcing the turns. This may be an elastomeric or plastic material, more particularly rubber.

The thus configured antenna has the advantage of having a surface S2 which is distant from the disturbances of the main body 2*a*.

The loop has flexibility provided either by the coating or sheathing, or by the material the turns are made of, for example, steel.

Such a configuration advantageously makes it possible to hook or grip the device. When in contact connection mode, the antenna has several degrees of freedom; it may thus be moved to several directions and thus not hamper another connection, if any, of another device to be connected to another computer port.

Here again, the antenna is mobile with respect to the electronic circuit, more particularly at a point of junction 9 with the body 2*a*.

In FIG. 2, the device 2*b* includes the same means as mentioned above, and the elements bearing the same reference numbers in the Figures are similar, with the letters associated with the numbers relating to the specific mode. This can be applied to all the Figures.

In this example, the device, as a USB key, includes means making it possible to retract the antenna inside the device. These include a slide 6 wherein a button 7 slides for executing such operation. The device includes a sleeve 8 along the body, which is able to receive the antenna, in the retracted position. The antenna is flexible and, inside, it takes an oval (or another) shape to be inserted into the sleeve.

Inside, the antenna is connected to the electronic circuit by connection means which follow motions as a ribbon or a flexible bifilar wire. Here, the antenna is mobile and retractable with respect to the electronic circuit so as to be extracted from an internal position wherein it is placed opposite the device and take a field-free external position, so as to seize the electromagnetic field. The antenna is also flexible with respect to the electronic circuit.

In FIG. 3, the device 2*c* is a USB key and the elements bearing the same reference numbers are identical and similar as mentioned above.

In this embodiment, the antenna 3*c* is positioned in a cover 10*c* which is articulated with respect to the body of the device with a hinge 11.

The cover could also be differently mobile with respect to the internal circuit 5 inside the rigid main body 2*c*. For example, the cover could slide with respect to the body so as to offset the antenna at least partially outside a surface opposite the electronic circuit contained in the body.

In the expanded position of the cover, in FIG. 3*b*, the antenna shows its coupling surface as free for seizing an electromagnetic field in so far as it is offset with respect to the main body. In this position, the communication range is larger or more efficient.

When in a position for connection with electric contacts, the device remains thin and narrow in expanded position or not expanded position, without interfering with other keys.

In FIG. 4, the device according to a third embodiment includes removable means making it possible to retract the so-called main body 2*f* or at least the internal electronic circuit, with the latter being accommodated in or on a cap or any other added element.

Here, the antenna is provided in a cover or cap 10*d* which has receiving means 15 making it possible to fix or receive the main body containing the electronic circuit and to connect it, if need be.

In an alternative solution, the antenna 3*d* is a passive antenna only, which is used as a relay by another antenna provided in the main body 2*d* which provides the function of radiofrequency transponder. The passive antenna includes, if need be, a capacity on both ends.

The cap includes a reception space 15 in the main body. Connection points 13*d* or a connector adapted for connecting one or several electronic component(s) providing the function of radiofrequency communication in the body 2*d* are provided at the bottom of such a space.

The connection points can be connected with contact points of the beating body which are accessible from the outside of the beating body. For example, connection lines opening into the USB connector 4, as explained in greater details in FIG. 5.

However, the antenna connection points can also open into any other place of the beating body 2*d* provided for this purpose.

The cap 10*d* has a total surface S1 which is much larger than that of the body 2*d*. When the body is fixed to the cap or the antenna support 10*d* or received inside same, the antenna has portions S1*a* and S1*b* which are not directly opposite the body and are thus basically exposed to the electromagnetic field of an external reading terminal. A flap 40 closes the reception space 15.

Thanks to these provisions, the device can easily be taken away as a single block, in the assembled configuration thereof and be placed in a handbag or same, so as to carry out an access control.

The antenna coupling surface is calculated as a function of the overall dimensions of the body, so as to reach the requested range. In addition, as regards the connection to the Internet via a computer port, it is sufficient to extract the body 2*d* from the sleeve 10*d*, here a USB key, so as to obtain a narrower or thinner body and connect it to the USB port, and provide a USB communication without interfering with other connections.

Various caps having different sizes and ranges can be selected, if need be, as per the user's needs, for example, according to the position of the device on him/her, or in a handbag and the way it is shown to a driver. Because of the removable function of the antenna, the invention enables a customisation of the radiofrequency device as regards the range thereof.

In FIG. 5, according to a fifth embodiment of the invention showing removable means of the antenna, the device 1*e* includes a cap which is substantially complying with the preceding Figure and includes the antenna 3*e*. As previously, the same reference numbers refer to the same elements, even with slight variations shown by various associated letters.

According to one characteristic, the device includes a circuit 18*a*, 18*b* for connection with the antenna, which is at least partially positioned on the beating body 19 and which extends on at least a part of the electronic/electric circuit 23, 24, up to the antenna connection points 20, 21. Such points are accessible from the outside of the beading body. Such points show, if need be, junction points of the antenna which is removable or detachable from such points or connection points located in the immediate vicinity of these points.

According to one characteristic of the invention, the device includes a USB connector 4 comprising Vbus 20 and GND 21 tracks and the connection circuits 18*a*, 18*b* are respectively connected to such tracks.

The junction with the electronic circuit is materialized here by electric connection pads 23, 24 of a chip card 25 connector. In the example, the RF circuit is contained in a chip card 25, but it could be placed in the electronic circuit of the beating body.

According to another characteristic, the connection circuit 18*a*, 18*b* includes two capacities C1, C2 each one being positioned between the electronic/electric circuit 23, 24 and the connection points 20, 21 and a USB circuit protection circuit intended to filter the RF signal superimposed on the Vbus.

The USE circuit includes a protection with respect to the radiofrequency signals seized and transmitted by the antenna. Such a protection is here a choke coil placed at the USB circuit inlet.

According to one characteristic, the antenna is accommodated in a removable cap 16 which is capable of connecting both antenna ends with the Vbus and GND tracks, respectively.

The cap thus comprises means of connection to the USB connector capable of being retracted into the connector and connecting the Vbus and GND tracks. The connector is typically a complementary USB connector, two tracks of which only are connected by the antenna.

The device according to the preferred version of the invention composes or constitutes a part 26 providing a function of chip card 25 USB driver. The electronic circuit of the invention includes the USB driver circuit and an ISO 22 connector for connecting the chip card 25, with the latter including an electronic circuit with a dual ISO/RF interface.

According to one characteristic, the antenna includes a field presence indicator provided in the cap (not shown). This indicator may be, for example, a vibrator or a sound or light indicator. For example, a circuit including one or several diode(s) ("leds") may be placed in the antenna circuit, so as to produce a light effect which can be customized according to the user's choice (pattern, colour, etc.).

The user can then be led to use, among several indicator caps, the one which will give the indicator, as per the considered use.

According to another alternative solution, the cap in FIG. 5 may be fixed at the back of the device, on connection points specifically prepared for this purpose, if need be. For example, one PCB of the key may have connection tracks extending backwards and being accessible through a slot provided in the shell.

As for the cap, it may include a protruding flat portion matching the slot and bearing the antenna tracks. When introduced into the slot, the protrusion causes an ohmic contact of the antenna with the tracks for connection to the electronic circuit and/or RF.

The invention claimed is:

1. A radiofrequency communication device that comprises:

a graspable body having a surface;

an electronic and/or electric circuit housed in the graspable body, wherein the electronic circuit is configured to operate in a contactless mode and a contact mode;

at least one removable antenna, a connection circuit for connection to the removable antenna, that is provided at least partially in the graspable body and extends from the electronic circuit up to connection points for the removable antenna, said removable antenna connection points being accessible from the outside of the graspable body, and a connector having conductors for connecting the electronic circuit to a terminal port, to operate in the contact mode, said removable antenna connection points being connected to said conductors, wherein the connector is configured to be removeably connected to the antenna, to thereby connect the antenna to the connection points, to operate in the contactless mode.

2. A device according to claim 1, wherein said connector is a USB connector.

3. A device according to claim 1, wherein the connection circuit comprises two capacitors, each one being provided between the electronic circuit and the connection points and a USB circuit protection circuit composed of a choke coil to filter an RF signal.

4. A device according to claim 1, wherein the removable antenna is accommodated in a removable cap or element for connecting both antenna ends to the conductors respectively.

5. A device according to claim 4, wherein the removable antenna comprises an electromagnetic field presence indicator provided in the cap.

6. A device according to claim 1, comprising a chip card USB driver, with the electronic circuit being a circuit of the USB driver, comprising an ISO connector for connecting the chip card, and the chip card comprising an electronic circuit with a dual ISO/RF interface.

7. A device according to claim 1, wherein the removable antenna is flexible with respect to the electronic circuit.

8. A device according to claim 1, wherein the removable antenna comprises at least a radiofrequency antenna turn provided in the vicinity of the electronic circuit and defining an electromagnetic coupling surface inside the turn.

* * * * *